US006739247B2

(12) United States Patent
Forno

(10) Patent No.: US 6,739,247 B2
(45) Date of Patent: May 25, 2004

(54) PRINTING DEVICE FOR ROTOGRAVURE PRINTING MACHINES

(75) Inventor: Mario Forno, Asti (IT)

(73) Assignee: Officine Meccaniche Giovanni Cerutti S.p.A., Casale Monferrato (IT)

( * ) Notice: Subject to any disclaimer, the term of this patent is extended or adjusted under 35 U.S.C. 154(b) by 19 days.

(21) Appl. No.: 10/108,492

(22) Filed: Mar. 29, 2002

(65) Prior Publication Data

US 2003/0183445 A1 Oct. 2, 2003

(51) Int. Cl.[7] ..... B41F 9/10

(52) U.S. Cl. ..... 101/157; 101/156; 101/155; 101/168; 101/169

(58) Field of Search ..... 101/157, 154, 101/155, 156, 167, 168, 169, 350.1

(56) References Cited

U.S. PATENT DOCUMENTS 5,437,227 A * 8/1995 Straubinger ..... 101/169
5,636,566 A * 6/1997 Kipp ..... 101/153

FOREIGN PATENT DOCUMENTS

DE 3201178 A * 7/1983 ..... B41F/9/10
JP 57070666 A * 5/1982 ..... B41F/31/04
JP 10278221 A * 10/1998 ..... B41F/9/10
JP 2003260393 A * 9/2003 ..... B05C/1/08
WO WO 9814329 A * 4/1998 ..... B41F/9/02

OTHER PUBLICATIONS

Machine translation of JP 10278221 A to Ishimoto from Japanese Patent Office website.*

* cited by examiner

*Primary Examiner*—Daniel J. Colilla
(74) *Attorney, Agent, or Firm*—Miles & Stockbridge P.C.; James T. Carmichael

(57) ABSTRACT

A printing device (1) is disclosed for rotogravure printing machines comprising: a printing cylinder (3) with notches (50) for printing liquid, a rubber roller (4) for pushing paper web supports (2) against the cylinder (3) in order to print, and a scraper member (7) for cleaning the surface of the printing cylinder (3) of printing liquid not contained in notches (5); the scraper member (7) is equipped with thrusting members (9, 10) central therewith that thrust a central portion of the scraper member (7) towards the cylinder (3) in order to bend the scraper member (7) such that the bend in the scraper member (7) follows a bending to which the cylinder (3) is subjected upon the rubber roller (4) being pushed against the cylinder (3).

9 Claims, 2 Drawing Sheets

PRINTING DEVICE FOR ROTOGRAVURE PRINTING MACHINES

BACKGROUND OF THE INVENTION

1. Field of the Invention

The present invention refers to a printing device for rotogravure printing machines, and in particular to a printing device comprising an improved doctor member.

2. Background Information

The current rotogravure printing machines are equipped, as can be seen in FIG. 1, with a printing device 1 that substantially comprises at least one printing cylinder 3 equipped on its external surface with a plurality of notches 5 adapted to contain printing liquid (usually ink), and at least one scraper member 7 for every printing cylinder 3. This scraper member 7 is of a type commonly known as doctor and is thrust in contact with the surface of the printing cylinder 3 in order to remove the ink that can be found on the cylinder 3 surface outside of the notches 5, in order to clean the cylinder 3 itself. Ink is "fished" from a tank (not shown) placed under the cylinder 3 and wets the cylinder 3 surface when this latter one performs a rotation printing pass.

Printing on paper supports 2 (usually continuous webs of paper of various types) is carried out through the pressure of a rubber roller 4 that thrusts the paper itself against the printing cylinder 3. This pressure, that is usually applied vertically towards the ground, for 3680-mm wide paper webs (that are the typical paper webs that are commonly used) can reach values that are equal to 15 kg/cm and therefore the rubber roller 4 applies to the printing cylinder 3 a force that is equal to about 6000 kg. Since the printing cylinder 3 is connected to two fixed ends 11, 13 in order to rotate around its longitudinal axis, this force tends to thrust the cylinder 3 downwards (towards the ground) progressively distorting through flexure the cylinder 3 surface up to a value that, next to the central part of the cylinder 3 itself, gets to 1 mm of downwards flexure (starting from a 0-mm flexure value next to the fixed ends 11, 13).

When working, therefore, the printing cylinder 3, the paper web 2 and the rubber roller 4 assume an arc-shaped configuration due to the downwards flexure of all three components, with a flexure difference that progressively goes from 0 to 1 mm along the whole extension of the cylinder 3. Obviously, for different types of workings, different flexure extensions can and could be provided, that anyway all imply the same problem that follows.

The doctor-type scraper member 7 is composed of an elongated blade 16, commonly 0.15-mm thick, that is pressed in contact with the cylinder 3 surface in order to allow it to scrape ink away. Due to the simultaneous presence of a high working speed, of the contact pressure between scraper member 7 and cylinder 3, for the thrust of all ink to be moved and above all for the above flexure to which the cylinder 3 is subjected, the scraper member 7 works differently along the cylinder 3 extension: in fact, ink is completely removed next to the ends 11, 13 and always more poorly removed when going away from the ends 11, 13, since the cylinder 3 surface is also moving away by flexure from the blade 16 of the scraper member 7. This different ink-scraping capability is further translated into a different wear of the scraper member 7, since a smooth contact between itself and the cylinder 3 is progressively missing.

SUMMARY OF THE INVENTION

Object of the present invention is solving the above prior-art problems, by providing a printing device 1 in which the scraper member 7 follows with a maximum accuracy the progressive flexure of the printing cylinder 3, in order to guarantee a smooth ink scraping in all its points.

A further object of the present invention is providing a printing device 1 of the above-mentioned type that can be realised with a minimum number of pieces, at a reduced cost and without increasing the final encumbrances of the rotogravure machine to which it is applied.

A further object of the present invention is providing a printing device 1 and a related process for which the force applied to the scraper member 7 in order to allow it to follow the flexure of the printing cylinder 3 can be automatically determined according to the diameter of cylinder 3 and roller 4, and according to other working parameters, also automatically determined.

The above and other objects and advantages of the invention, as will appear from the following description, are obtained by a printing device and a process as claimed in claims 1 and 6. Preferred embodiments and non-trivial variations of the present invention are claimed in the dependent claims.

BRIEF DESCRIPTION OF THE DRAWINGS

The present invention will be better described by some preferred embodiments thereof, given as a non-limiting example, with reference to the enclosed drawings, in which.

DESCRIPTION OF PREFERRED EMBODIMENTS OF THE INVENTION

Figure 1:
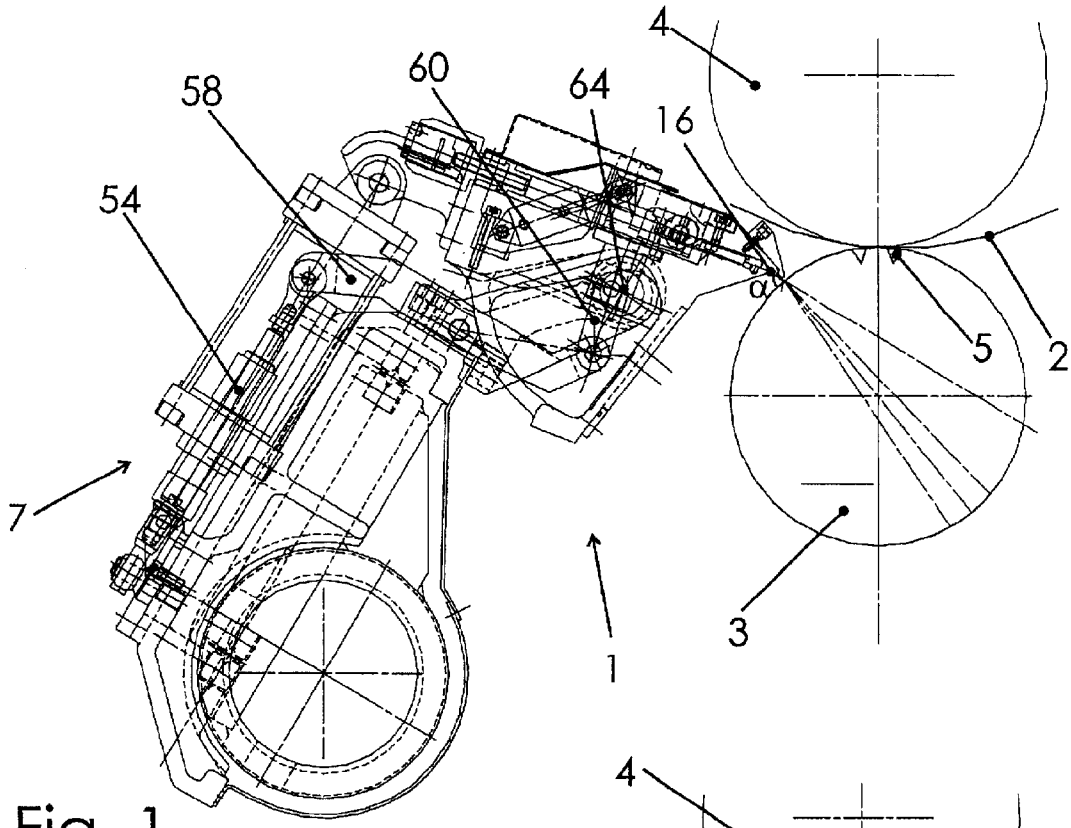
FIG. 1 is a side view of a printing device 1 according to the present invention, applied to known printing cylinders.

With reference to the Figures, a preferred non-limiting embodiment of the printing device 1 of the invention will now be described. As already previously seen, such device 1 comprises a printing cylinder 3 and a rubber roller 4 through which a continuous web 2 (for example of paper) passes, in addition to the scraper member 7, which, as known, is subjected to a pressure that thrusts it towards the cylinder 3 surface. Such pressure is commonly realised by two pneumatic pistons 54, 56 placed next to the ends 11, 13, that, through a linkage 58, 50 thrust the head 64 on which the scraper member 7 is applied, against the cylinder 3 surface.

A further hydraulic piston 66 is also known, that is preferably placed in a central position with respect to the cylinder 3: such further piston 66 is used to adjust the approaching movement of the scraper member 7 and to dampen possible vibrations. This known piston 66, however, cannot be used to guarantee a constant pressure when the cylinder is subjected to the above-described progressive flexure.

Therefore, it has been necessary to provide a new and inventive printing device 1, in which the scraper member 7 is further equipped with at least one thrusting member 9 or 10 placed in a central position with respect to the fixed ends 11, 13 of the scraper member 7.

Figure 3:
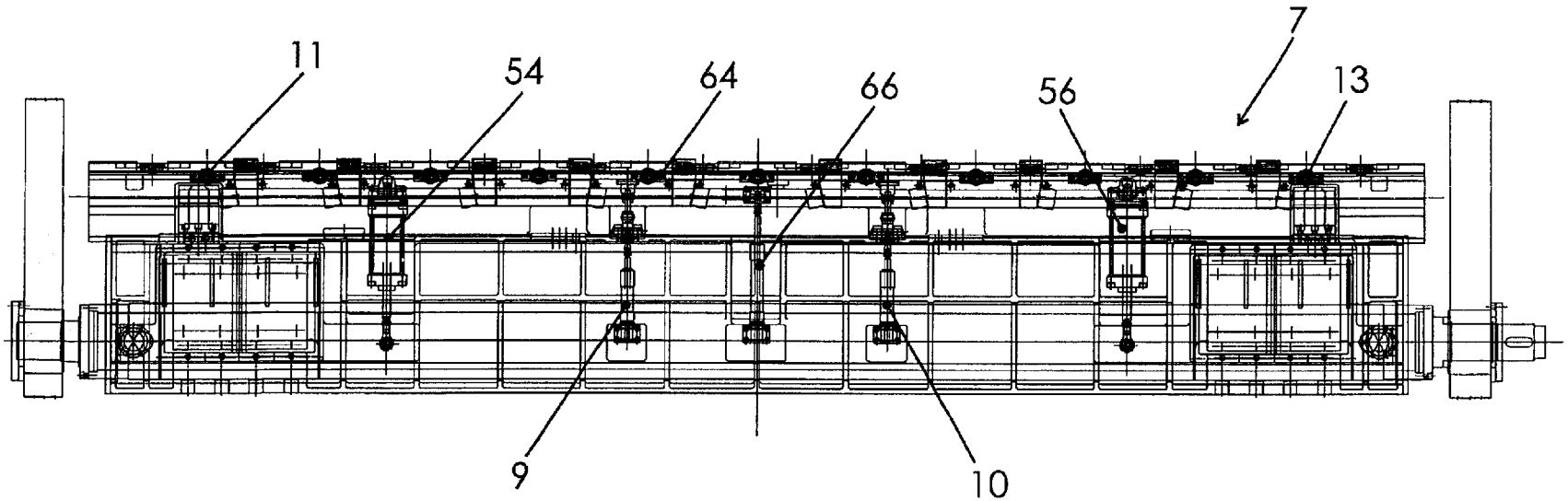
FIG. 3 is a front view of the scraper member 7 of the present invention.

FIG. 3 in practice shows the presence of two thrusting members 9, 10 placed next to and mutually at the same distance with respect to the central point between the fixed ends 11, 13 of the scraper member 7. In FIG. 3, the two thrusting members 9, 10 are placed on opposite sides of the piston 66. In practice, however, as mentioned above, the thrusting member could be only one, placed next to piston 66, but separated therefrom both physically and functionally. For applications with very long printing cylinders 3 or if the case so requires, it is possible to provide a number of thrusting members 9, 10 that is greater than two, such members 9, 10 being uniformly placed on the whole of part of the surface of the cylinder 3, in the points where it is necessary to thrust the scraper member 7 so that it follows the flexure of the printing cylinder 3.

In any case, summarising, the thrusting member or members 9, 10 are adapted to thrust the scraper member 7 towards the surface of the printing cylinder 3 in a central position in order to realise a bending of the scraper member 7 next to the bending to which the printing cylinder 3 is subjected upon thrusting the rubber roller 4 against the printing cylinder 3.

In the embodiment shown, the thrusting members 9, 10 are composed of at least one hydraulic cylinder connected to the support 14 of the blade 16 of the scraper member 7. Obviously, other types of members can be provided that are adapted to realise the same functionality.

Figure 2:
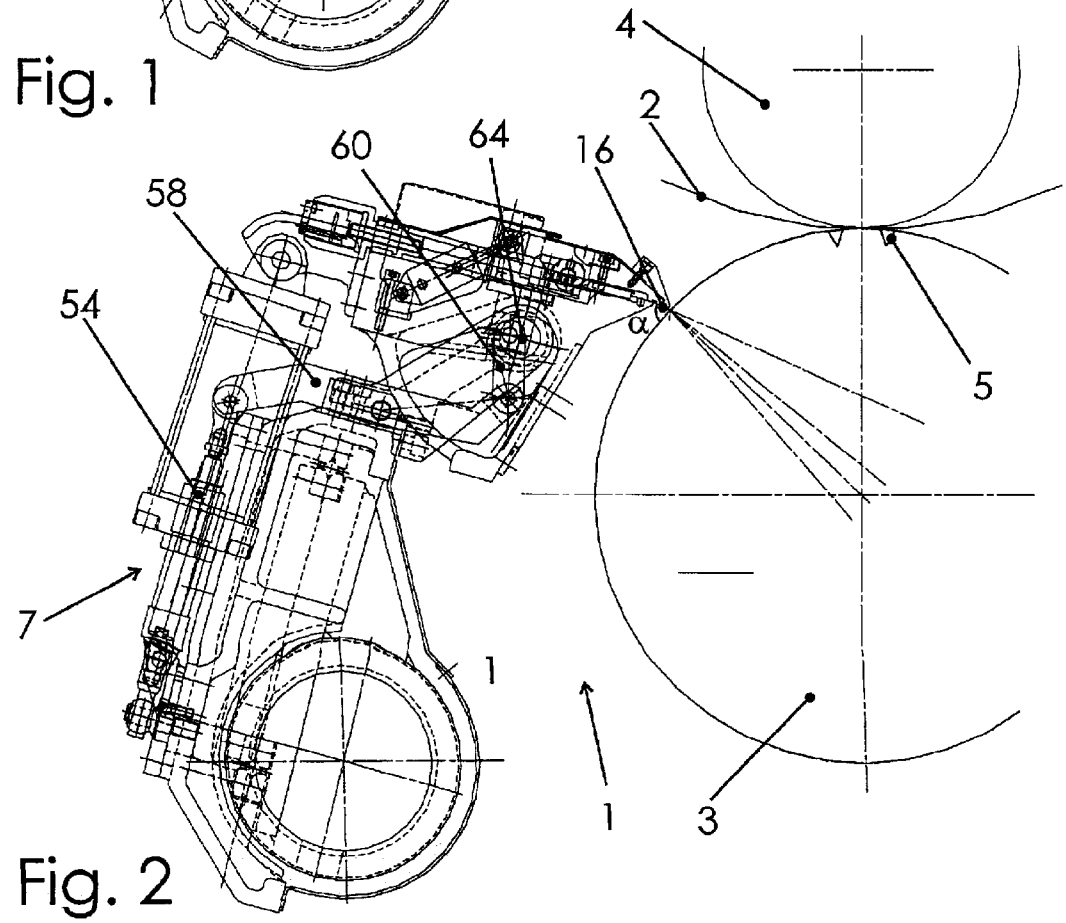
FIG. 2 is a side view similar to FIG. 1 that shows the scraper member 7 cooperating with two different types of cylinder 3 and roller 4.

As can be seen in FIGS. 1 and 2, the scraper member 7 is configured in to maintain a constant bearing and working angle ($\alpha$) with the surface of the printing cylinder 3, no matter what the diameter of the printing cylinder 3 is: FIGS. 1 and 2 show cases of different diameters of cylinder 3 and roller 4.

A preferred structure through which the above characteristics are realised is again shown in FIGS. 1 and 2: here, the thrusting members 9, 10 are driven through suitable linkages by the same motor that drives the pressure of the piston 66 of the scraper member 7 onto the printing cylinder 3.

With the above-described printing device 1, it is thereby possible to arrange the thrusting members 9, 10 in order to realise a progressive thrust of the scraper member 7 to guarantee smooth working angle and pressure (and thereby a smooth ink scraping) on the surface of the printing cylinder 3.

The setting of the thrusting forces to be applied to the scraper member 7 can be manually performed by an operator according to the type of foreseen working, or an automatic process can be provided that, according to the measured quantities that affect the process (particularly cylinder 3 diameter, but also varying working cylinders according to the situations), allows always applying the same necessary force to guarantee a perfect contact of the scraper member 7 with the printing cylinder 3.

Such automatic process for cleaning the printing device 1 (that can be managed by programmable controller, or by computers aboard the machine) comprises the steps of:

providing at least one printing cylinder 3 equipped on an external surface thereof with a plurality of notches 5 adapted to contain a printing liquid;

providing at least one rubber roller 4 for every printing cylinder 3, wherein the rubber roller 4 is adapted to thrust paper web supports 2 against the printing cylinder 3 in order to print onto the paper web supports 2;

providing at least one scraper member 7 for every printing cylinder 3, where the scraper member 7 is of a doctor type and is thrusted in contact with the surface of the printing cylinder 3 in order to remove the printing liquid not contained in the notches 5;

obtaining a diameter measure of the printing cylinder 3 and the rubber roller 4;

computing, based on the obtained diameter of the printing cylinder 3 and the rubber roller 4, a thrusting force to be applied to the scraper member 7 in its central position with respect to its fixed ends 11, 13; and through the thrusting member 9, 10, thrusting with the computed force the scraper member 7 towards the printing cylinder 3 in its central position in order to bend the scraper member 7 next to a bending to which the printing cylinder 3 is subjected upon thrusting the rubber roller 4 against the printing cylinder 3.

As stated above, the diameters of printing cylinder 3 and rubber roller 4 can be manually entered into automatic means (not shown) for computing and applying the thrusting force to the scraper member 7.

Alternatively, and preferably, the diameters of printing cylinder 3 and rubber roller 4 can be obtained through sensors measuring the related diameter values and sending them to the automatic means for computing and applying the thrusting force to the scraper member 7.

Other sensors (or equivalent measuring means) could be provided to measure other quantities affecting the process, such as for example working speed, scraper member 7 wear, type of paper, etc.

What is claimed is:

1. A printing device for rotogravure printing machines comprising:

at least one printing cylinder equipped on an external surface thereof with a plurality of notches adapted to contain a printing liquid;

at least one rubber roller for each printing cylinder, said rubber roller being adapted to push paper supports against said printing cylinder in order to print onto said paper supports, wherein a central portion of said printing cylinder is flexed away from fixed longitudinal ends of the cylinder when said printing cylinder is subjected to said pushing from the rubber roller;

at least one scraper member for each printing cylinder wherein said scraper member is fixed at each longitudinal end, said scraper member being of a doctor type and being adapted to push into contact with said external surface of said printing cylinder in order to remove printing liquid not contained in said notches;

wherein said scraper member is equipped with at least one thrusting member placed in a central position with respect to the fixed ends of said scraper member, said thrusting member being adapted to thrust a central portion of said scraper member towards said printing cylinder such that the central portion of said scraper member is flexed away from the fixed ends of said scraper member towards the printing cylinder such that the flexed scraper member follows the flexure of said printing cylinder, and said thrusting member comprised of at least one hydraulic cylinder connected to a support of a blade of said scraper member.

2. A printing device according to claim 1, wherein two thrusting members are placed at equidistant locations from a central point between the fixed ends of said scraper member.

3. A printing device according to claim 1, wherein said scraper member is adapted to keep a constant bearing and working angle ($\alpha$) with the surface of d printing cylinder for any size printing cylinder.

4. A printing device, for rotogravure printing machines comprising:

at least one printing cylinder equipped on an external surface thereof with a plurality of notches adapted to contain a printing liquid;

at least one rubber roller for each printing cylinder, said rubber roller being adapted to push paper supports against said printing cylinder in order to print onto said paper supports, wherein a central portion of said printing cylinder is flexed away from fixed longitudinal ends of the cylinder when said printing cylinder is subjected to said pushing from the rubber roller;

at least one scraper member for each printing cylinder wherein said scraper member is fixed at each longitudinal end, said scraper member being of a doctor type and being adapted to gush into contact with said external surface of said printing cylinder in order to remove printing liquid not contained in said notches;

wherein said scraper member is equipped with at least one thrusting member placed in a central position with respect to the fixed ends of said scraper member, said thrusting member being adapted to thrust a central portion of said scraper member towards said printing cylinder such that the central portion of said scraper member is flexed away from the fixed ends of said scraper member towards the printing cylinder such that the flexed scraper member follows the flexure of said printing cylinder, said at least one thrusting member being controlled through a linkage.

5. A process for automatically cleaning a printing device for a rotogravure printing machine, wherein said printing device comprises at least one printing cylinder equipped on an external surface thereof with a plurality of notches adapted to contain a printing liquid, a rubber roller adapted to push paper supports against said printing cylinder in order to print onto said paper supports, wherein a central portion of said printing cylinder is flexed away from fixed ends of the printing cylinder when said printing cylinder is subjected to said pushing from the rubber roller;

comprising the steps of:

providing at least one scraper member for each printing cylinder, wherein said at least one scraper member is fixed at each longitudinal end, said scraper member being of a doctor type and being adapted to push into contact with said external surface of said printing cylinder in order to remove printing liquid not contained in said notches, and wherein said scraper member is equipped with at least one thrusting member placed in a central position with respect to the fixed ends of said scraper member;

obtaining diameters of said printing cylinder and said rubber roller;

determining, based on the obtained diameters of the printing cylinder and the rubber roller, a thrusting force to be applied to said thrusting member; and through the thrusting member, thrusting with the determined force said central portion of said scraper member towards said printing cylinder to bend said central portion of said scraper member to follow said flexure of said printing cylinder.

6. The process according to claim 5, wherein said step of obtaining diameters of said printing cylinder and said rubber roller comprises manually entering at least one value into means for determining the thrusting force.

7. The process according to claim 5, wherein said step of obtaining diameters of said printing cylinder and said rubber roller comprises measuring the diameters using sensors and sending measurements to means for determining the thrusting force.

8. A printing device according to claim 4, wherein two thrusting members are placed at equidistant locations from a central point between the fixed ends of said scraper member.

9. A printing device according to claim 4, wherein said scraper member is adapted to keep a constant bearing and working angle ($\alpha$) with the surface of said printing cylinder for any size printing cylinder.

* * * * *